United States Patent [19]

Summersby

[11] 4,162,031

[45] Jul. 24, 1979

[54] COMPUTER TAPE REEL HANDLING DEVICE

[76] Inventor: E. John Summersby, 4580 W. 170th St., Lawndale, Calif. 90260

[21] Appl. No.: 894,927

[22] Filed: Apr. 10, 1978

[51] Int. Cl.[2] ..... B65D 71/00

[52] U.S. Cl. ..... 224/45 K; 206/403; 220/4 E

[58] Field of Search ..... 224/45 K, 45 D, 48 F, 224/45 R, 48 R; 206/310, 397, 403, 486, 444, 493, 405; 211/49 R, 194; 248/159; 190/58 B; 16/115, 110.5; 220/4 B, 4 E

[56] References Cited

U.S. PATENT DOCUMENTS

| | | | |
|---|---|---|---|
| 1,736,640 | 11/1929 | Waterer | 190/58 B |
| 2,723,417 | 11/1955 | Furholmen | 16/115 |
| 3,077,281 | 2/1963 | Braverman | 220/4 E |
| 3,252,568 | 5/1966 | Steidinger | 206/403 |
| 3,635,608 | 1/1972 | Crouch et al. | 206/444 |
| 4,085,875 | 4/1978 | Campbell et al. | 224/45 K |

*Primary Examiner*—Joseph J. Rolla
*Assistant Examiner*—Kenneth W. Noland
*Attorney, Agent, or Firm*—Romney, Schaap, Golant, Disner & Ashen

[57] ABSTRACT

A computer tape reel carrying and storage device having just ten parts, all of which are paired identically. Most of the parts are of plastic and the identical pairs be molded in the same mold. The parts may easily be assembled to form a cylindrical body having a flange at its lower end and a movable handle at its upper end. The handle moves from a retracted position for loading or unloading to an extended position for locking the reels in place and facilitating the transport of the device and reels.

1 Claim, 5 Drawing Figures

Fig. 1
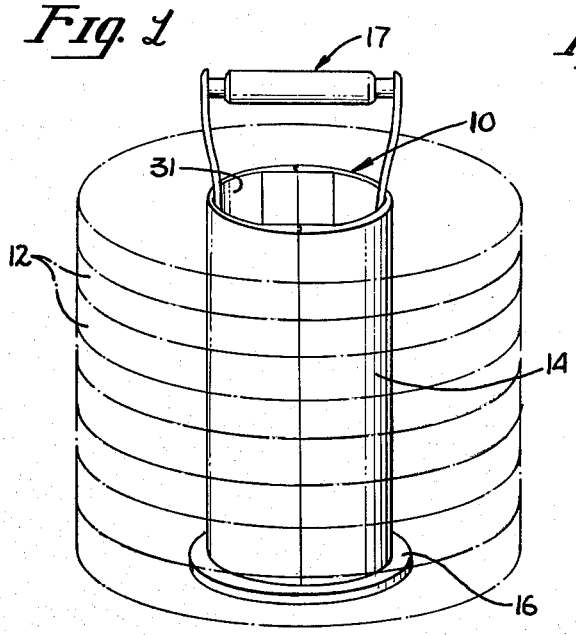
Fig. 3
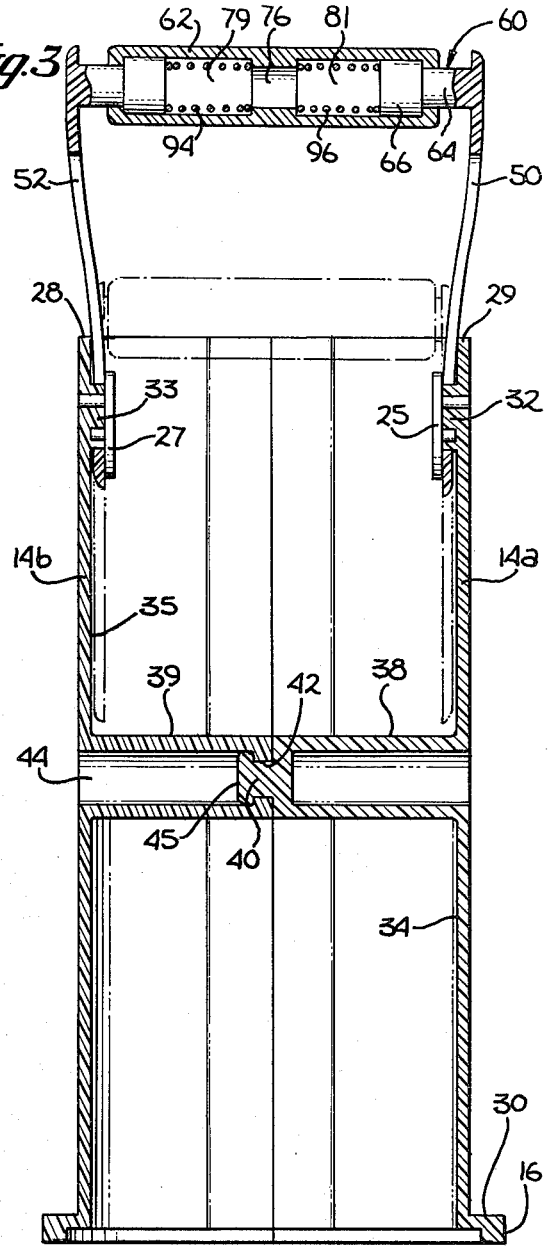
Fig. 2
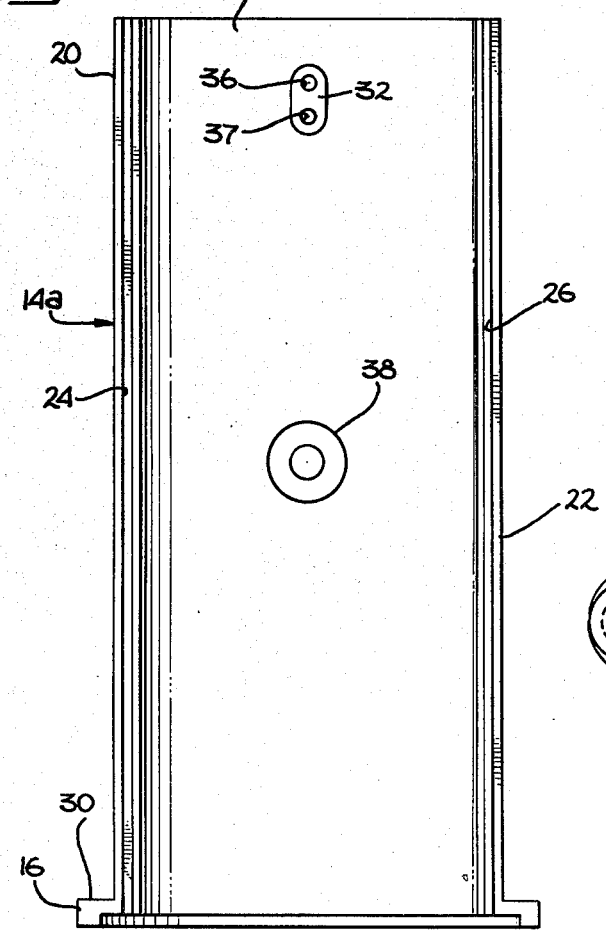
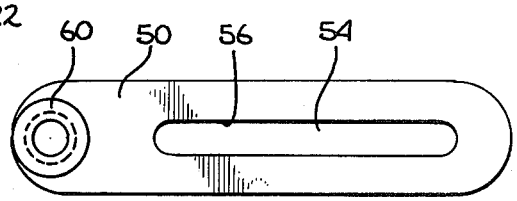
Fig. 4
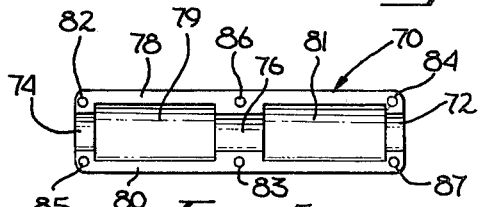
Fig. 5

COMPUTER TAPE REEL HANDLING DEVICE

BACKGROUND OF THE INVENTION

1. Field of the Invention

The present invention relates to a handling device and, more particularly, to a handling device ideally suited for computer tape reels, the device being light-weight, inexpensive and fully portable so that a user may easily transport a plurality of tape reels from one place to another. The device is particularly useful in that it can serve as a temporary storage for tape files until they are required, and in combination, the handling device and its load of tape reels occupies no more space than the tape reels themselves.

2. Description of the Prior Art

There are existing apparatus and methods for both transporting and/or providing storage for computer tape reels. Most simply, tape reels can be hand-carried, one at a time. Except where only one tape reel is actually needed, this method is relatively inefficient. Generally, most medium to large scale computer installations use several tape units at a time and hence, usually require the simultaneous handling of several tape reels at a time.

Multiple tape reels are often transported from one point to another utilizing hand pushed, wheel mounted carts. This apparatus can handle a large number of tape reels, but is relatively inefficient where only a moderate number of tape reels are required to be transported, and such an apparatus is both relatively expensive and space consuming.

For longer term storage requirements, fully enclosed metal or plastic packages for completely covering individual tape reels are required. For short or intermediate term storage, individual tape reel packages are both relatively expensive and time consuming, as extra handling is concerned to transfer the reel to and from the package. Further, usual computer user practice has been to place such individual tape reel packages, when in storage, in or upon special racks or shelving. These also are relatively expensive and possibly inconvenient for short or intermediate term storage.

SUMMARY OF THE INVENTION

The above-mentioned problems in the prior art are overcome by the present invention which provides a handling device comprising an upright body for receiving items to be handled, the body having two substantially identical sections which form the body when connected, a flange at one end portion of the body for limiting movement of and providing support for the items and means at the other end portion for cooperating with a handle whereby the body can be carried; and a handle connected to the other end portion movable between extended and retracted positions, the handle including two arms and a grip portion.

A basic objective of the present invention is to provide a simple and easy to manufacture and assemble tape reel handling device which would have a low unit cost.

A further objective of the present device is to provide a sturdy yet light-weight handling device for transporting several tape reels.

Still another aspect of the present invention is to provide a tape reel handling device which is simply constructed with a minimum number of parts.

Another aim of the present invention is to provide a handling device having parts identical with other parts so as to be made of synthetic resin using a minimum number of molds.

Yet another object of the invention is to provide a convenient and low cost method of transporting and/or storing tape files.

The foregoing objects, advantages, features and results of the present invention together with various other objects, advantages, features and results thereof which will be evident to those skilled in the art in light of this disclosure may be achieved with the exemplary embodiment of the invention described in detail hereinafter and illustrated in the accompanying drawings.

BRIEF DESCRIPTION OF THE DRAWINGS

FIG. 1 is a perspective view of the inventive handling device illustrated in solid line supporting eight computer tape reels drawn in phantom line.

FIG. 2 is an elevational view of a body section of the handling device shown in FIG. 1.

FIG. 3 is an elevational sectional view of the handling device illustrating the handle in an extended position using solid lines and in a retracted position using phantom lines.

FIG. 4 is an elevational view of an arm portion of the handle.

FIG. 5 is an elevational view of a grip portion of the handle.

DESCRIPTION OF THE PREFERRED EMBODIMENT

While the present invention is susceptible of various modifications and alternative constructions, an embodiment is shown in the drawings and will herein be described in detail. It should be understood, however, that it is not the intention to limit the invention to the particular forms disclosed; but, on the contrary, the intention is to cover all modifications, equivalents and alternative construcions falling within the spirit and scope of the invention as expressed in the appended claims.

Referring now to FIG. 1, there is illustrated a handling device 10 illustrated as it might be used to carry or store eight computer tape reels 12 which are illustrated in phantom lines. The handling device is comprised of a main cylindrical body 14 having at its lower end a supporting flange 16 and at its upper end a reciprocal handle 17. In the fashion illustrated, an operator is able to transport a plurality of computer tape reels in a comfortable and natural manner, or the reels may be easily stored without removing them from the device.

A major advantage of the inventive handling device is that it is simply constructed of relatively few parts. Also importantly, each of those parts come in identical pairs to minimize manufacture and simplify assembly. For example, referring to FIGS. 2 and 3, the cylindrical body 14 is illustrated in more detail. This part designated **14*a* is one of two identical (the other is designated 14*b*) sections of the body around which the computer tape reels are supported. The section 14*a* is semi-cylindrical in shape having two longitudinal edges 20 and 22. The edge 20 includes a longitudinal groove 24 while the edge 22 includes a longitudinal projection 26. When each section 14*a* and 14*b*** is turned toward the other so that when brought together they form a cylindrical body, it becomes apparent that the projection of one section is received by the groove of the other section thereby allowing the two sections to be engaged one with the other in a predetermined alignment.

In order to minimize expense and facilitate manufacture, it is contemplated that the various parts will be constructed of a suitable synthetic resin such as polystyrene.

At the lower ends of the sections 14*a*, 14*b* is the flange 16. The flange is integrally connected to the sections and forms a surface 30 upon which a computer tape reel may be supported. The upper ends 28, 29 of the sections are continuous to form an opening 31, FIG. 1 to allow the retraction of the handle 17 which will be described in more detail below. In order to guide the handle between its extended and retracted positions, a pair of pads 32, 33 is provided on the interior walls 34, 35 of the sections. Each pad has two openings such as the openings 36, 37 of the pad 32 to receive two prongs from a tab such as tabs 25, 27. Projecting inwardly from the interior wall 34 of the section 14*a* is a stem 38 while a stem 39 projects from the wall 35. As can be seen from FIG. 3, the stem 38 includes an integral leg 40. By removing an analogous leg from the stem 39 an opening 42 is formed so that when the sections 14*a* and 14*b* are brought together the leg 40 is received by the opening 42. A tunnel opening 44 in the stem 39 is provided so that access may be had to the foot 45 of the leg 40 from outside the device. Once the parts have been brought together a heating element may be inserted through the opening 44 in the stem 39 to soften and flatten the foot 45 of the leg to cause permanent locking engagement of the sections.

Also exemplifying the advantages of the present invention is the handle. The handle 17 is simply constructed and yet capable of moving between a retracted and extended positions. For example, in FIG. 1 the handle is shown in an extended position. The same is true in FIG. 3. However, as shown in phantom lines in FIG. 3, the handle may be retracted. Referring now to FIGS. 3 and 4, portions of the handle are shown in greater detail. The handle includes two opposing identical arms 50, 52, one of which is shown in FIG. 4 and will be described in detail. Since the arms are identical they may be formed from the same mold. The arm 50 is an elongated strip of flexible material having a central slot opening 54 bounded by a surface 56. As can be seen in FIG. 3 the pad 32 is received within the slot 54 creating a cam-cam follower arrangement with the tabs 25, 27 restraining the arms to sliding movement only. In this manner, the arms may be guided during their transition between the extended and retracted positions as the surface 56 moves relative to the pad 32. At one end of the arm is a finger 60 having a neck portion 64 and a seat portion 66 which is received within the grip 62 of the handle. As may be appreciated, the entire arm including the finger 60 may be molded in one piece with the thickness of the arm such as to allow flexing movement from the postion shown in solid lines in FIG. 3 to the position shown in phantom lines.

The grip 62 is illustrated in FIGS. 3 and 5. As with the earlier described parts, the grip is made in two identical halves or sections of which only section 70, FIG. 5 is described in detail. Since the sections are identical, they may be constructed from the same mold. Section 70 is semi-cylindrical in shape having restricted end openings 72 and 74 which trap the neck of the arm such as the neck 64. At the mid-section of the section 70 is an internal flange 76 which forms with longitudinal edges 78 and 80, two spring chambers 79, 81. The grip sections each include corresponding tips and holes such as the tips 82, 83, 84 and the holes 85, 86, 87. It can be readily seen that when the sections are put together, the tips and holes mate.

Within each of the chambers 79, 81 is a compression spring 94, 96 biased between the internal flange 76 and the seat portion such as the seat portion 66 of the arm 50. As seen in FIG. 3, when the arm is extended the springs bias the arms outwardly. However, it can be appreciated that when the handle is retracted, the interior wall 34, 35 of the body sections will bias the arms inwardly causing the fingers to compress the springs so that contraction and retraction can occur.

What has been described in a simple, yet reliable handling device which can be made inexpensively but yet have enough strength and sturdiness to withstand normal abuse in its use environment.

While a major advantage of the present invention is that the handling device may be easily and inexpensively manufactured, it can also be easily assembled. Once the parts are collected, the two body sections, the two arms, the two grip halves, the two springs and the two lugs, the unit may be quickly put together. First, the springs and the seat portions of the arms are placed within one of the grip sections. Next, the other grip section is engaged so as to form a completed handle. Next, the two body sections are brought together and the foot of the leg is heated and deformed. The last step is to place the arms over the pads and press the tabs into position thereby entrapping the arms. The result is a lightweight yet inexpensive computer tape carrying unit.

In operation, the handle is in a retracted position to allow the loading from one to a plurality of computer tape reels by slipping the reels over the upper end 28, 29 of the device, moving the reel downward until limited by the flange 16. Once the desired number of reels have been placed around the device, the handle is extended to allow the device and the reels to be carried about. When it is necessary to remove a tape the handle is again retracted and the reel is merely lifted upwardly. It is to be appreciated that reels may also be stored on the device simply by placing the device with its reels onto a shelf. There is no need to transfer the reels from the carrying device to a rack. Thus, all of the computer tape reels of a particular program may be easily kept together and removed as a unit when desired.

What is claimed is:

1. A handling device comprising:

an upright cylindrical body for receiving items to be handled, said body having two substantially identical semi-cylindrical sections which form said body when connected, wherein each of said body sections includes an internally laterally extending projection stem for attaching said sections one to the other;

said sections are joined along longitudinally extending edges wherein each section includes one longitudinal projection and one longitudinal groove;

a flange at one end portion of said body for limiting movement of and providing support for said items;

means at said other end portion of said body for cooperating with a handle whereby said body can be carried;

a handle connected to said other end portion moveable between extended and retracted positions, said handle including two arms and a grip portion, wherein each of said arms includes at one end portion an elongated slot-like opening forming a boundary surface for guiding said arms relative to said body during movement between said extended and retracted positions, and at an opposite end portion a spring seat projection for engaging a biasing spring wherein the opposite end portions of said arms are biased outwardly when said arms are in said extended position;

said body including internally extending pads which extend through said slot-like opening for sliding along said boundary surface and tabs mounted to said pads for entrapping said arms; and said spring positioned in said grip portion for biasing said arms outwardly when in said extended position.

* * * * *